US007225841B2

(12) United States Patent
Folk

(10) Patent No.: US 7,225,841 B2
(45) Date of Patent: Jun. 5, 2007

(54) COLLAPSIBLE CONTAINER FOR CONTAINING LIQUID, SUCH AS SPENT MOTOR OIL, AND METHOD OF USING SAME

(75) Inventor: Randall W. Folk, 1451 Rye Rd. E., Bradenton, FL (US) 34202

(73) Assignee: Randall W. Folk, Bradenton, FL (US)

( * ) Notice: Subject to any disclaimer, the term of this patent is extended or adjusted under 35 U.S.C. 154(b) by 123 days.

(21) Appl. No.: 10/978,859

(22) Filed: Nov. 1, 2004

(65) Prior Publication Data

US 2006/0090811 A1 May 4, 2006

(51) Int. Cl.
*B65B 3/16* (2006.01)

(52) U.S. Cl. ..... 141/114; 141/10; 141/86; 220/666; 220/768

(58) Field of Classification Search ..... 141/2, 141/10, 18, 86, 114; 4/506, 488; 220/666, 220/768, 613, 678; 114/74 R
See application file for complete search history.

(56) References Cited

U.S. PATENT DOCUMENTS

| | | | | |
|---|---|---|---|---|
| 2,443,440 | A * | 6/1948 | Alvarez | 102/230 |
| 2,718,014 | A * | 9/1955 | Mizrach et al. | 4/506 |
| 3,474,844 | A | 10/1969 | Lindstrom et al. | |
| 3,703,956 | A | 11/1972 | Oswalt | |
| 4,054,184 | A | 10/1977 | Marcinko | |
| 4,064,969 | A | 12/1977 | Black | |
| 4,157,103 | A | 6/1979 | La Fleur | |
| 4,195,710 | A | 4/1980 | Garrison | |
| 4,485,853 | A | 12/1984 | Gunderson | |
| 4,513,865 | A | 4/1985 | Melzi et al. | |
| 4,705,248 | A | 11/1987 | McIntyre | |
| 4,823,947 | A | 4/1989 | Maynard, Jr. | |
| 5,080,149 | A | 1/1992 | Peoples | |
| 5,121,776 | A | 6/1992 | Kovach | |
| 5,190,085 | A | 3/1993 | Dietzen | |
| 5,379,862 | A | 1/1995 | Schmidt et al. | |
| 5,862,940 | A | 1/1999 | Chism et al. | |
| 5,930,849 | A * | 8/1999 | Marbach | 4/506 |
| 5,946,744 | A * | 9/1999 | Peterson | 4/506 |
| D418,150 | S | 12/1999 | Maynard | |
| 6,408,453 | B1 * | 6/2002 | Song et al. | 4/506 |

* cited by examiner

*Primary Examiner*—Timothy L. Maust
(74) *Attorney, Agent, or Firm*—Brian J. Laurenzo; Jason M. Hunt

(57) ABSTRACT

A collapsible container for retaining and disposing liquids is described. The container includes an expandable liquid retaining portion and an inflatable top ring. As liquid, such as used motor oil, pours into the expandable liquid retaining portion the inflated top ring floats on top of the liquid as the liquid retaining portion expands. A top cover, which may be formed by flexible flaps with zip lock closures, may be included to seal the container for transport. A drain hole may be provided through a bottom portion of the container to drain the liquid out of the container. A handle may be provided to facilitate carrying the container filled with oil.

16 Claims, 6 Drawing Sheets

COLLAPSIBLE CONTAINER FOR CONTAINING LIQUID, SUCH AS SPENT MOTOR OIL, AND METHOD OF USING SAME

FIELD OF INVENTION

This invention relates generally to a collapsible device for containing and disposing of liquid, and especially for containing and disposing of used motor oil. More specifically, the invention relates to a container that includes an inflatable top ring that floats on top of liquid within the container as the liquid drains from a reservoir into the container.

BACKGROUND

Most internal combustion engines of the type used in automobiles require a lubricant to reduce friction between moving parts. Traditionally this lubricant has been a petroleum based product; however, recently, synthetic lubricants have become popular. Generically, all of these lubricants will be referred to in this document as "motor oil" or simply "oil." This motor oil is typically stored in the engine within a reservoir, such as an oil pan, and circulated through the engine during use. A drain plug is located near the bottom of the oil pan to permit motor oil to be drained out of the engine.

Through use and the passage of time, a motor oil can become contaminated or chemically altered such that it loses some of its lubricating properties. Therefore, periodically it is desirable to drain the old motor oil out of the engine, and replace it with fresh oil. The process of draining the old oil involves removing the drain plug from the oil pan, and allowing the old oil to flow out of the engine through the force of gravity. A receptacle needs to be used to capture and contain the oil as it flows out of the engine. Commonly this receptacle is a container having an open top that is placed on the ground underneath the car in alignment to catch the oil as it pours out of the drain opening in the bottom of the engine's oil pan.

Because used motor oil can be toxic and hazardous, care must be taken to dispose of it safely. Therefore, a common strategy is to pour the used oil from the container into which it drained into a transport container, so that the oil may be safely transported to a disposal site. Alternatively, a disposable liner, such as a plastic bag, may be placed in the container, and then sealed after the oil has been drained into it so that the oil can be transported to the disposal site in the sealed liner.

The current mechanisms for collecting and disposing the old oil have several drawbacks. It can be messy and awkward to place and remove a liner from the container. Rigid containers can take up more storage space than collapsible devices.

What is needed is a mechanism for collecting and containing drained motor oil that is collapsible, convenient to use, and cost efficient. Preferably the device will allow for easy transportation and disposal of the used motor oil.

SUMMARY OF THE INVENTION

The invention described herein solves many of the problems associated with existing oil collection containers. According to one embodiment of the present invention a collapsible container for collecting and retaining liquid includes an inflatable top ring and an expandable liquid retaining portion extending below the top ring. The top ring is sealingly attached to the liquid retaining portion and will float on liquid within the liquid retaining portion when inflated. The collapsible container may include a cover comprising flaps and a sealing mechanism to retain liquids within the collapsible container. The collapsible container may also include a handle comprising holes located above the sealing mechanism in the flaps. A drain opening and closure element may be provided to allow liquid to be selectively drained from the liquid retaining portion.

According to another embodiment, the invention comprises a method of disposing of liquid from a reservoir by providing a collapsible container that has an expandable liquid retaining portion and an inflatable top ring. The top ring is inflated, and the collapsible container is placed in alignment with the reservoir, such that liquid draining from the reservoir drains into the expandable liquid retaining portion. Liquid is allowed to drain from the reservoir into the expandable liquid retaining portion, thereby expanding the liquid retaining portion and floating the inflated top ring on top of the liquid within the liquid retaining portion. The collapsible container is removed from reservoir, and the liquid within the collapsible container is then drained into a disposal location. The method may also include sealing a top closure prior to transporting the collapsible container to the disposal location. The method may also include draining liquid from the collapsible container into the disposal site by removing a drain closure from the collapsible container. The reservoir may be a lubricant pan for an internal combustion engine, and the liquid may be a lubricant.

DETAILED DESCRIPTION OF PREFERRED EMBODIMENTS

Figure 1:
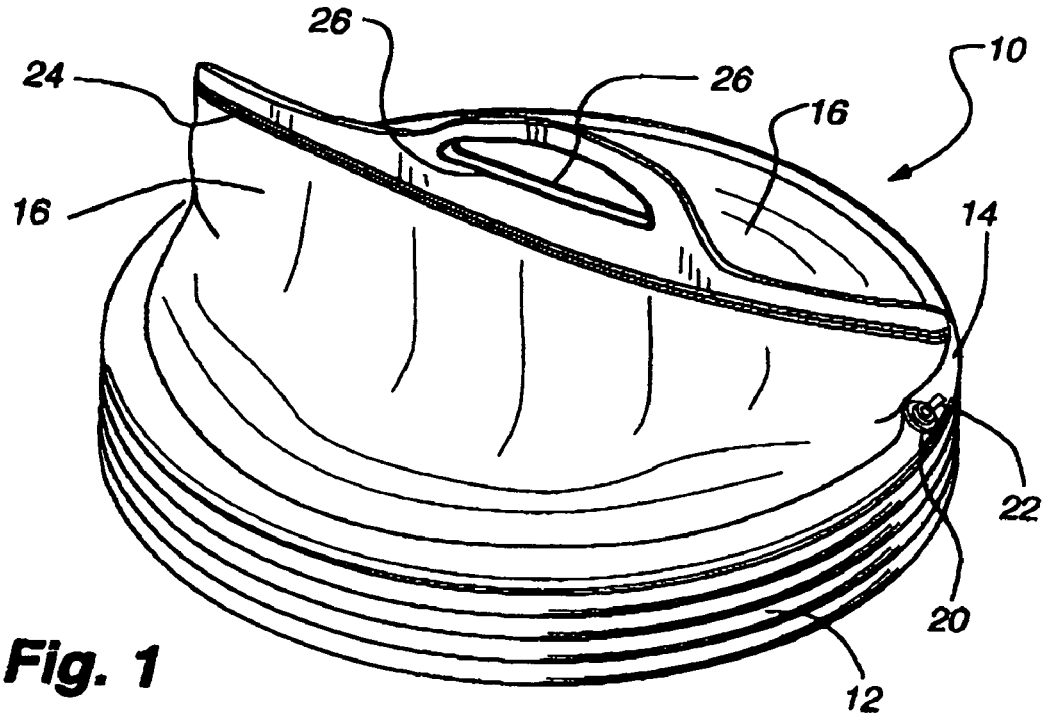
FIG. 1 is an isometric view a collapsible container according to one embodiment of the present invention in an extended position with a top cover closed.

Shown generally in the figures and described in detail herein is a collapsible container 10 for use in collecting and retaining liquid drained from a reservoir. The container 10 is especially well-suited for use in collecting used motor oil as it drains from an automobile engine. After the oil is collected in the container 10, the container may be used to safely and conveniently transport the oil to a proper disposal location.

A first embodiment of a collapsible container 10 is shown in FIGS. 1–4. The container 10 includes a flexible sidewall 12, a top ring 14, and a pair of cover flaps 16. A bottom portion 18 (not shown in FIG. 1) is connected to the sidewall 12 opposite from the top ring 14. The top ring 14 is inflatable through valve 20. A valve plug 22 is used to close the valve 20. A sealing mechanism, such as zip lock 24 is provided to permit the cover flaps 16 to be sealed shut. Handle openings 26 are provided near the top of each cover flap 16. A drain opening 28 and drain cap 30 are provided in the bottom portion 18 to allow liquid to be drained out of the container 10 through the bottom portion 18.

The sidewall 12 and bottom portion 18 form an expandable liquid retaining portion. Preferably the bottom portion 18 and sidewall 12 are formed from a single piece of material, such as rubber, plastic, or vinyl. The sidewall 12 should be flexible so that it will collapse nearly flat against the bottom portion 18 when not in use. An accordion design is preferred for the sidewall 12 to facilitate the sidewall 12 lying flat when it is collapsed.

The top ring 14 is an inflatable bladder similar to those used as flotation devices for water safety. Valve 20 may simply be a tube or straw that leads from the exterior to the interior of the ring 14 so that a user may inflate the ring by blowing air into the ring through the mouth, or by a mechanical air pump. Alternatively, a biasing mechanism (not shown) could be included within the top ring 20 to make the ring 20 self inflating. Plug 22, which is preferably tethered to the valve 20, can be inserted into the valve 20 to retain the air within the ring 14 to prevent it from deflating. When it is desired to deflate the top ring 14, the plug 22 can be removed and the air allowed to freely pass out of the top ring 14 through valve 20. The top ring 14 may be formed by any suitable material that is air tight and impervious to liquids such as motor oil. Rubber, vinyl and plastic may be suitable choices. The liquid retaining portion of the container 10, should preferably be of sufficient cross-sectional area that it can hold ten (10) quarts of liquid without being more than five (5) inches high.

Figure 2:
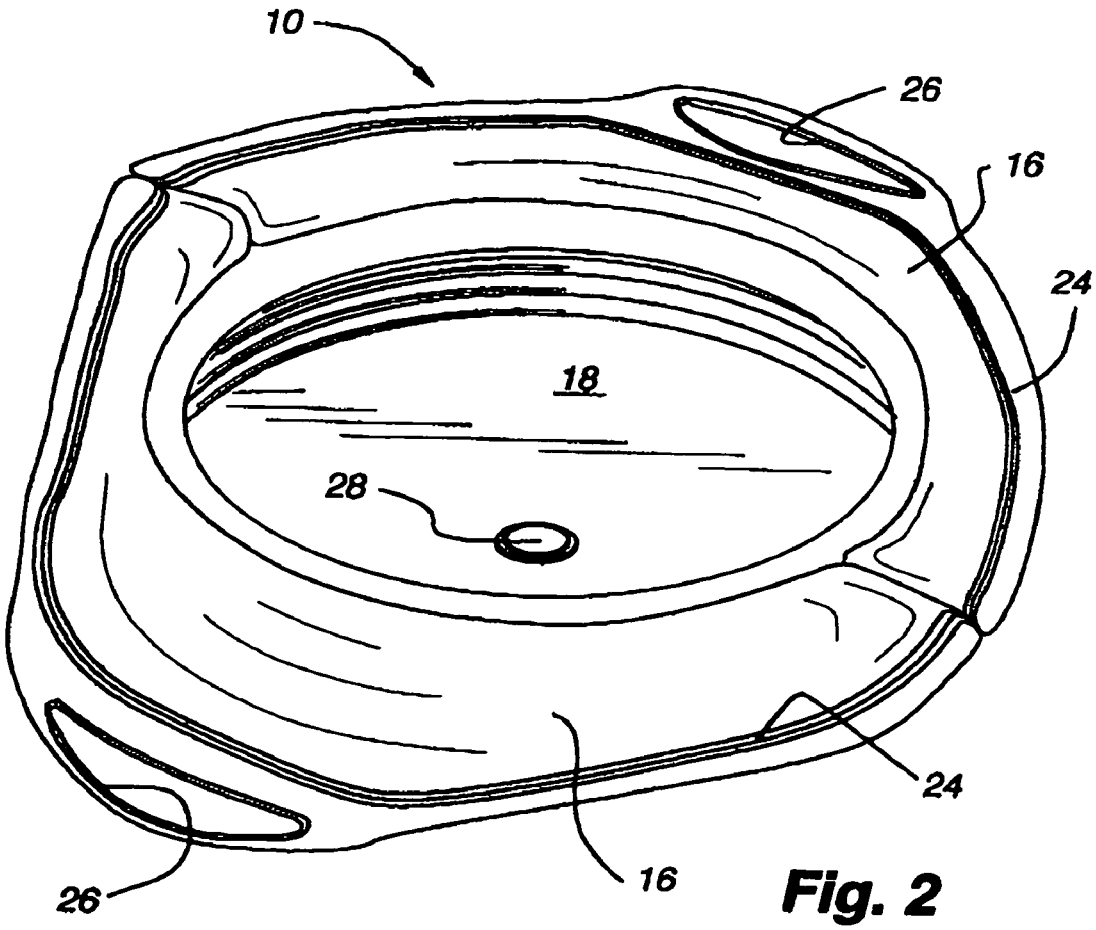
FIG. 2 is an isometric view of the collapsible container of FIG. 1 in a collapsed position with the top cover opened.
Figure 3:
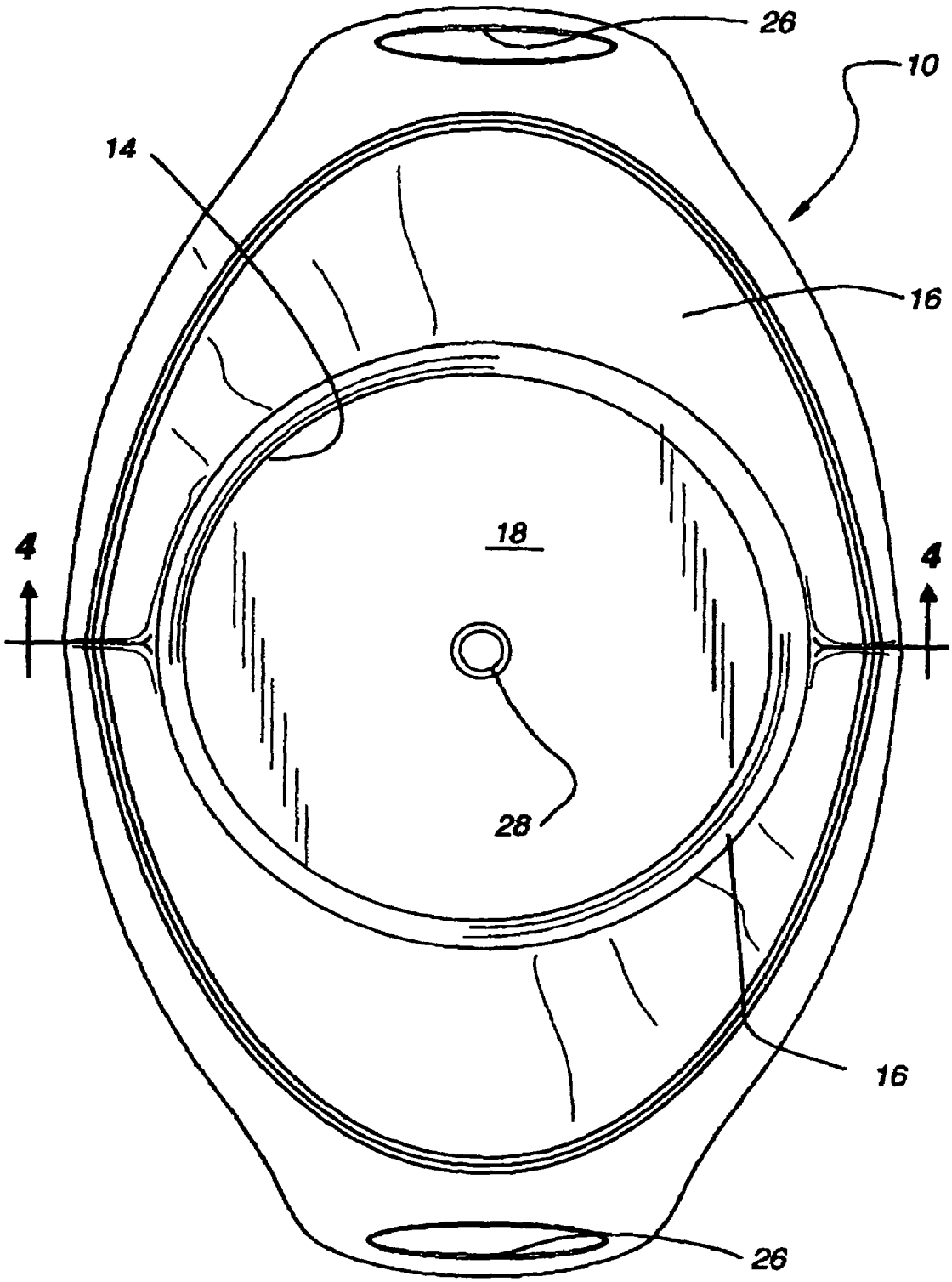
FIG. 3 is a top view of the collapsible container of FIG. 1 in the extended position with the top cover opened.
Figure 4:
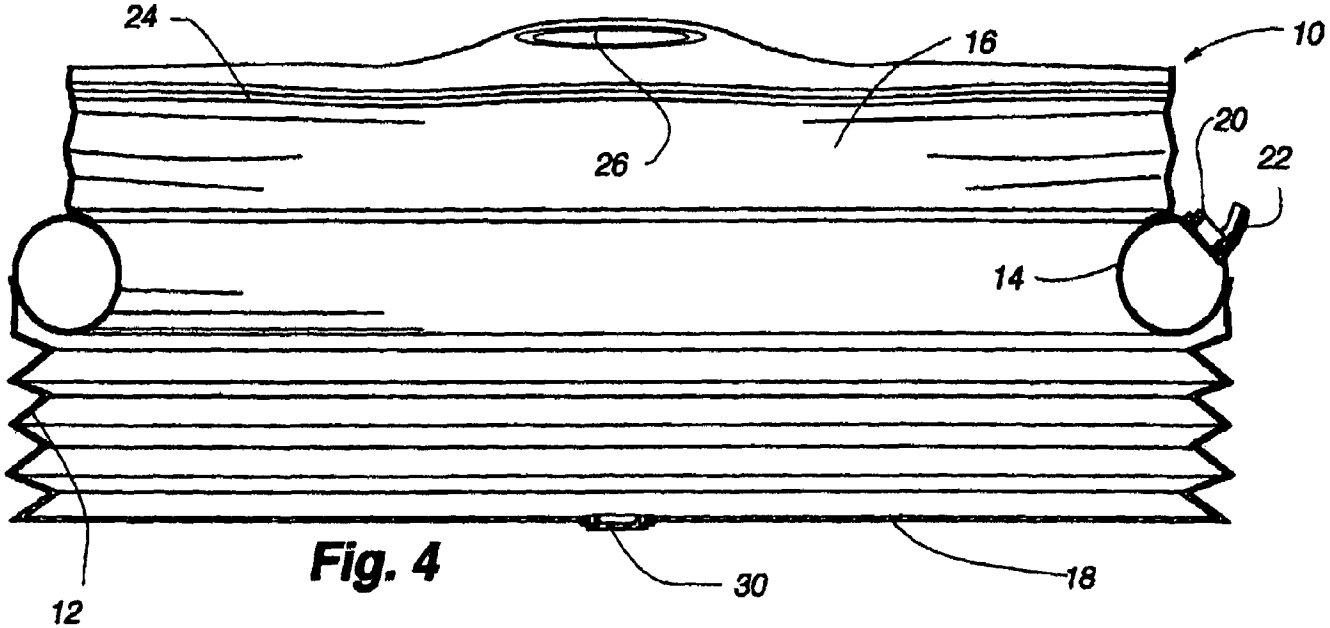
FIG. 4 is a cross-sectional elevation view of the collapsible container shown in FIG. 3 taken along section A—A.

The cover flaps 16 are made from flexible, liquid impervious material, such as rubber, vinyl or plastic. They can be adjusted between an open position as shown in FIGS. 2 and 3 and a closed position as shown in FIG. 1. In the open position, the flaps 16 are pulled apart from each other to permit liquid to flow into the liquid retaining portion of the container 10 formed by the bottom portion 18, sidewall 12 and top ring 14. In the closed position of FIG. 1 the cover flaps 16 are sealed together to prevent any liquid from leaking out of the container 10. In the embodiment shown, a zip lock arrangement is used to seal the cover flaps 16 together. Those of skill in the art will be aware of other sealing mechanisms such as adhesives, crimping, and the like may also be used to seal the cover flaps 16.

Handle openings 26 are provided near the top center of the cover flaps 16 above the zip lock 24. These handle openings 26 provide a grip that makes it easier to carry and transport the container 10, especially when the container 10 is partially filled with a liquid. It may be necessary or at least desirable to provide some sort of reinforcement or bracing for the handle openings to prevent the cover flaps 16 from tearing when the container 10 is lifted. It is important to locate the handle above the sealing mechanism.

The drain opening 28 and drain cap 30 allow the container 10 to be easily drained through the bottom portion 18 of the container 10. This is easier and cleaner than attempting to pour liquid out of the container 10 by tipping the container 10 and allowing the liquid to spill over the sides of the cover flaps 16. The drain cap 30 is preferably a threaded screw on type cap to provide a tight seal. When it is desired to drain liquid from the container 10, all that is necessary is to remove the drain cap 30 and allow gravity to urge the liquid out through the drain opening 28. It may desirable to at least crack the cover flaps 16 slightly open to permit pressure to equalize above the liquid as it drains.

Figure 5:
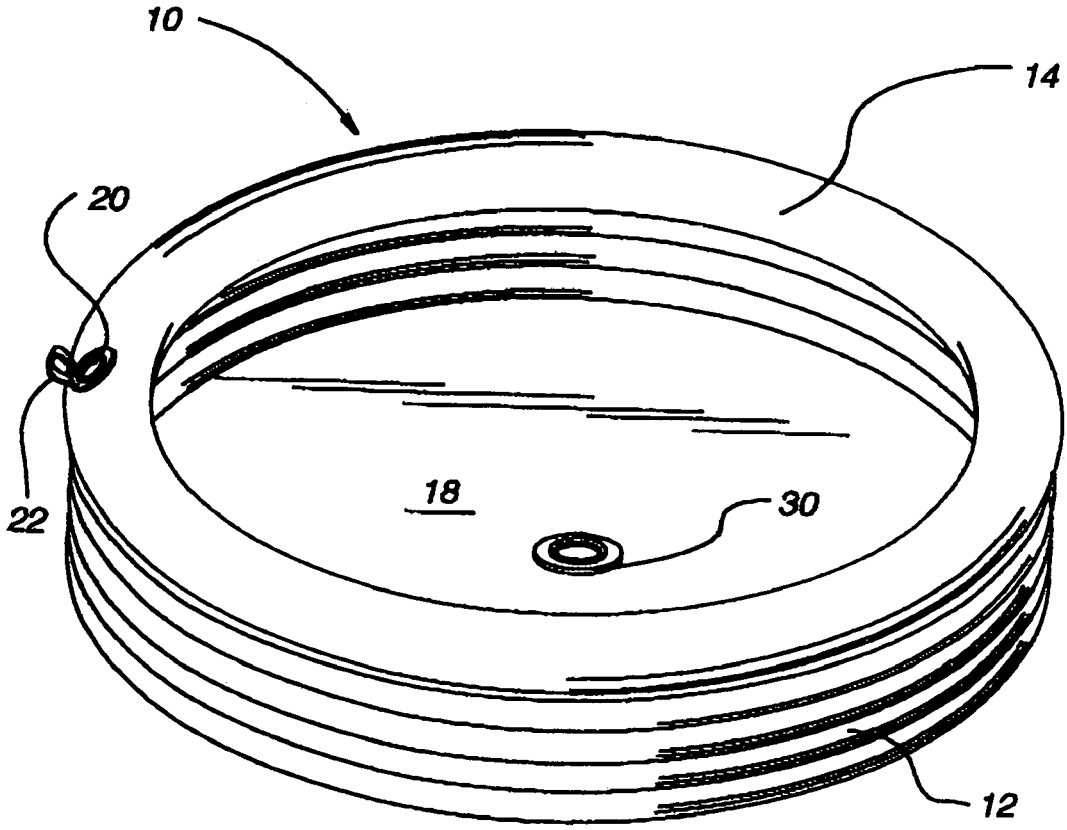
FIG. 5 is an isometric view a collapsible container according to another embodiment of the present invention that does not include a top cover.
Figure 7:
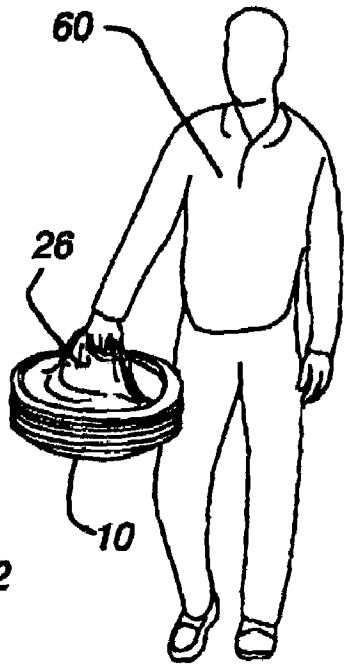
FIG. 7 is a side elevation view showing a collapsible container according to the present invention being carried by a user after it has been partially filled with a liquid to be disposed.

FIG. 5 shows another embodiment of a collapsible container 10 according to the present invention. The container 10 of FIG. 5 is similar to the embodiment of FIGS. 1–4, except that it does not include the cover flaps 16 or the drain opening 28 in the bottom portion 18.

As an alternative (not shown in the drawings), it may be possible to make the sidewall 12 inflatable. In that instance, the top ring 14 and the sidewall 12 would be inflated prior to locating the container 10 under the reservoir. The inflated sidewall 12 would provide the rigidity needed to retain the liquid within the container 10, and the top ring 12 would not need to float, and may be eliminated from the design.

Figure 6:
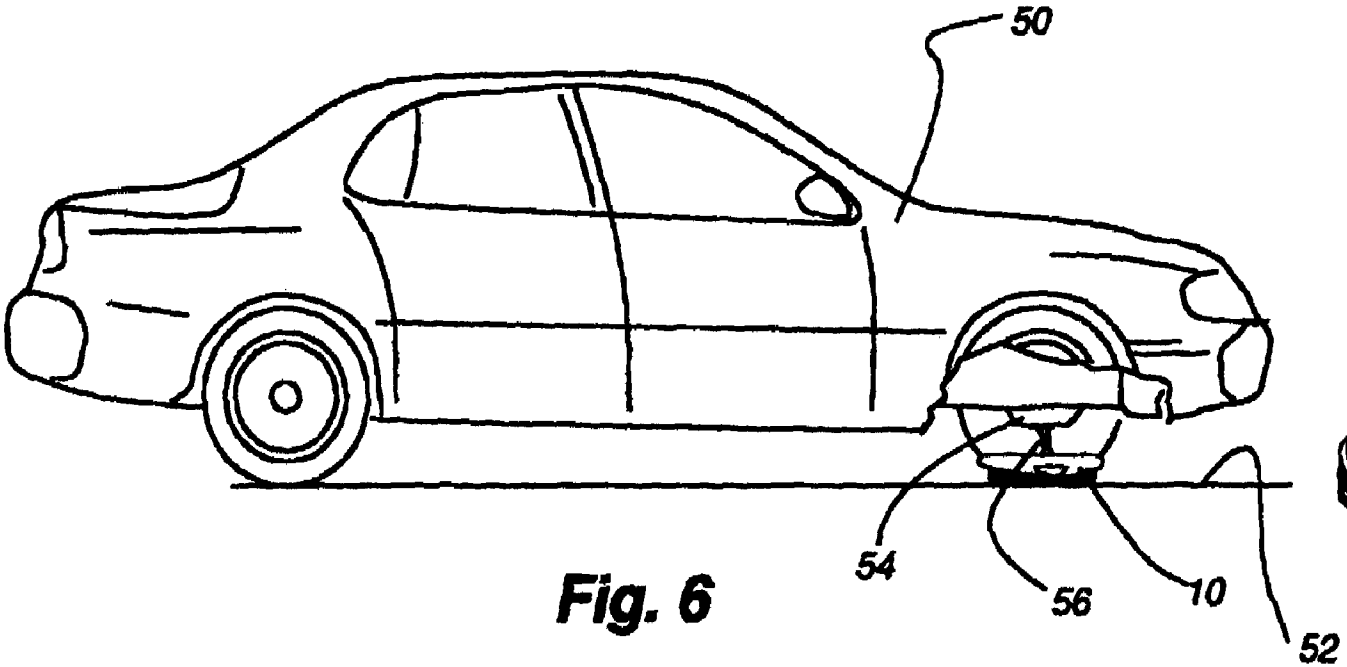
FIG. 6 is a side elevation view of a collapsible container according to the present invention in place beneath an oil reservoir of an automobile.

A preferred method of use of a collapsible container 10 according to the present invention is illustrated in FIG. 6. The container 10 is placed beneath an automobile 50, preferably on a generally flat level support surface 52 such as the ground or a floor. The container 10 should be beneath and in alignment with the oil pan 54 of the automobile so that the container 10 will collect and retain used oil 56 as is drains out of the oil pan 54. Preferably the oil 56 is drained at a time when it has been allowed to cool from its operating temperature. It may be desirable to use heat resistant materials to manufacture the container 10 to avoid failure in instances when a user drains the oil 56 before it has cooled. Preferably plastic that will withstand oil temperatures as hot as three hundred degrees Fahrenheit will be used.

Figure 8:
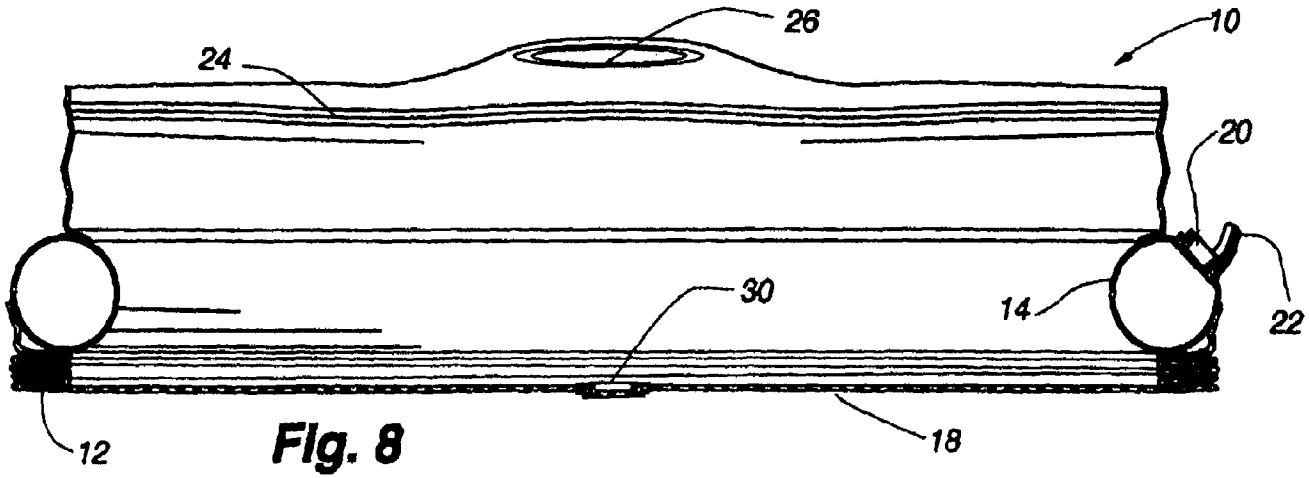
FIG. 8 is a cross-sectional elevation view of a collapsible container according to the present invention with the top ring inflated and the sidewall in a collapsed position.

FIG. 8 shows the container 10 as it should be configured when it is placed beneath the automobile 50 prior to initiating draining the oil 56 from the oil pan 54 of the automobile 50. As seen in FIG. 8, the top ring 14 should be inflated and sealed shut by the valve plug 22. The sidewall 12 will be in a collapsed position as the weight of the top ring 14 will press it downwards towards the bottom portion 18. The drain cap 30 should be securely fastened so that no oil will leak out. The cover flaps 16 should be pulled apart as far as possible to provide a large opening for the oil 56 as it drains out of the oil pan 54.

Figure 9:
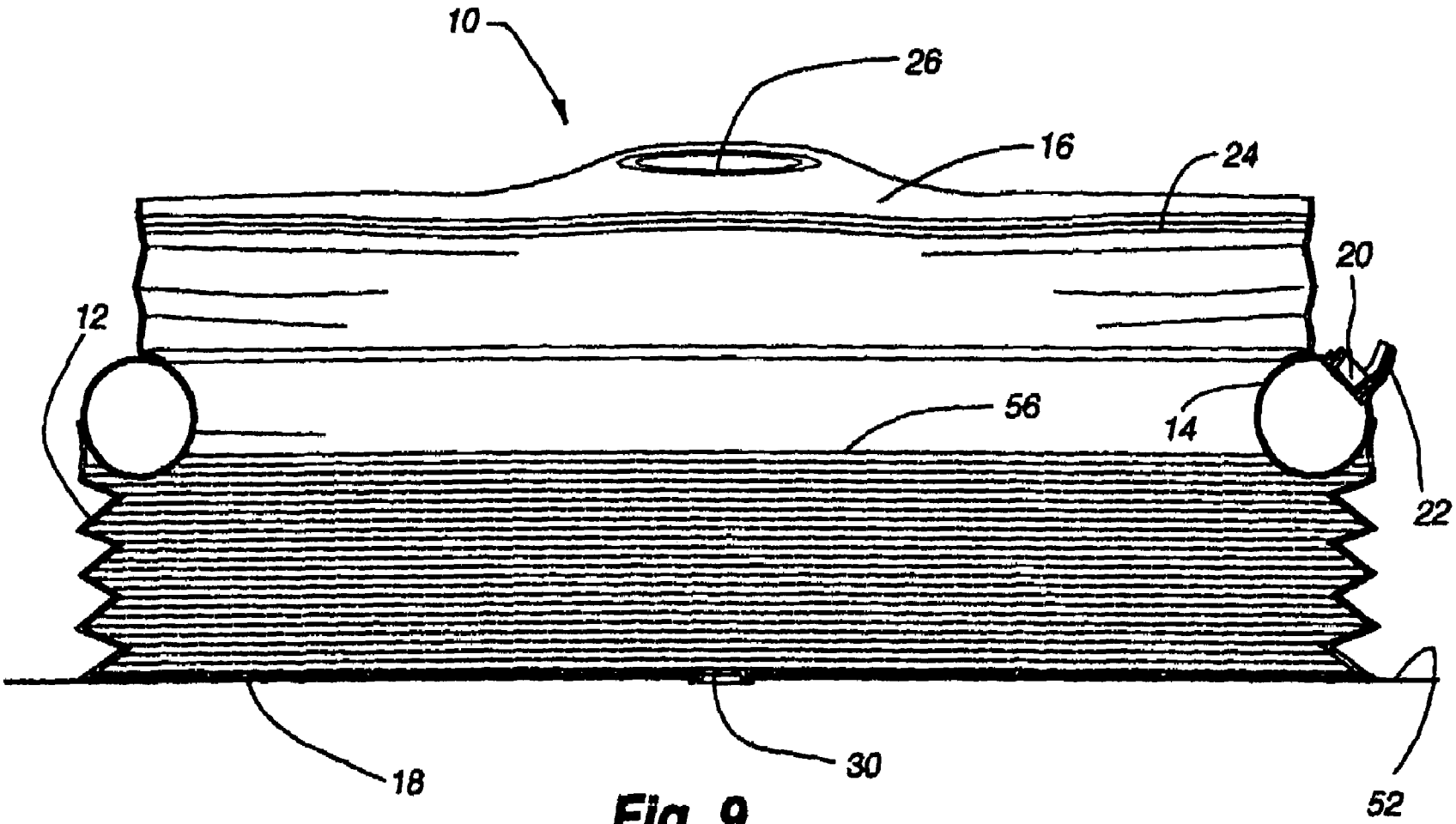
FIG. 9 is a cross-sectional elevation view of a collapsible container according to the present invention partially filled with oil.

As oil 56 drains into the container 10, the inflated top ring 14 will float on top of the oil 56, and being to rise as the oil level rises within the container 10. As a result, the sidewall 12 will expand upward to the expanded position shown in FIG. 9. After all the old oil 56 has been drained from the automobile 50, the container 10 can be slid out from underneath the automobile 10. The flaps 16 should be sealed tightly together by pressing the zip lock 24 closed. The used oil 56 is thusly safely retained within the container 10.

The used oil 56 may be safely transported to an appropriate disposal site within the container 10. A user 60 can conveniently carry the filled container 10 by grasping the handle openings 26. To drain the used oil 56 from the container 10, the drain cap 30 is removed and gravity causes the oil 56 to pour out the drain opening 28. The container 10 itself may then be disposed of, or may be cleaned and reused.

Although the present invention has been described with a certain degree of particularity, it is understood that the disclosure has been made by way of example, and changes in detail or structure may be made without departing from the spirit of the invention as defined in the appended claims. For example, while the invention has been described in the context of draining and disposing of used motor oil, the container may also be well suited for use in containing and disposing of other liquids.

I claim:

1. A collapsible container for collecting and retaining liquid, the container comprising:

an inflatable top ring, said top ring being lighter than the liquid when inflated;

an expandable liquid retaining portion extending below said inflatable top ring and being sealingly attached to said top ring such that said inflatable top ring will float on top of liquid within said liquid retaining portion when inflated; and a closing member having a sealing mechanism and being integral with said top ring for closing said container.

2. The collapsible container according to claim 1, wherein said closing member comprises a cover portion for enclosing said top ring in a liquid tight manner to retain liquid within the collapsible container.

3. The collapsible container according to claim 2 wherein said cover portion further comprises flaps and a sealing mechanism.

4. The collapsible container according to claim 3, wherein said sealing mechanism is a zip lock.

5. The collapsible container of claim 2, further comprising a handle.

6. The collapsible container of claim 3, further comprising a handle, and wherein said handle comprises openings in said flaps located above said sealing mechanism.

7. The collapsible container of claim 1, further comprising a drain opening located in a bottom portion of said expandable liquid retaining portion and a closure element for selectively closing said drain opening.

8. The collapsible container of claim 1, wherein said expandable liquid retaining portion comprises an accordion-like sidewall and a generally flat bottom portion.

9. A method of disposing of liquid from a reservoir comprising:

providing a disposable collapsible container comprising an expandable liquid retaining portion and an inflatable top ring;

inflating said top ring;

placing said collapsible container in aligmnent with the reservoir such that liquid draining from said reservoir drains into said expandable liquid retaining portion;

allowing liquid from said reservoir to drain into said expandable liquid retaining portion, said inflated top ring floating on top of said liquid within said liquid retaining portion;

removing said collapsible container with drained liquid from alignment with the reservoir; and transporting said container to a disposal site to drain said liquid from said liquid containing portion.

10. The method according to claim 9, wherein said collapsible container includes a top closure, and wherein the method further comprises sealing said top closure to retain said drained liquid within said collapsible container.

11. The method according to claim 10, wherein said top closure is formed by flexible flaps and a zip lock closure.

12. The method according to claim 9, wherein said collapsible container further includes a drain opening in a bottom portion of said expandable liquid containing portion, and wherein said step of draining said liquid from said liquid containing portion into a disposal location further comprises removing a closure from said drain opening and allowing said liquid to flow through said drain opening into said disposal location.

13. The method according to claim 9, wherein the reservoir is a lubricant pan for an internal combustion engine, and the liquid is a motor lubricant.

14. A collapsible container for collecting and retaining liquid, the container comprising:

an inflatable top ring, said top ring being lighter than the liquid when inflated;

an expandable liquid retaining portion extending below said inflatable top ring and being sealingly attached to said top ring such that said inflatable top ring will float on top of liquid within said liquid retaining portion when inflated.

a cover portion comprising flaps and a sealing mechanism for enclosing said top ring in a liquid tight manner to retain liquid within the collapsible container, wherein said sealing mechanism is a zip lock.

15. A collapsible container for collecting and retaining liquid, the container comprising:

an inflatable top ring, said top ring being lighter than the liquid when inflated;

an expandable liquid retaining portion extending below said inflatable top ring and being sealingly attached to said top ring such that said inflatable top ring will float on top of liquid within said liquid retaining portion when inflated;

a cover portion comprising flaps and a sealing mechanism for enclosing said top ring in a liquid tight manner to retain liquid within the collapsible container; and a handle, wherein said handle comprises openings in said flaps located above said sealing mechanism.

16. A method of disposing of liquid from a reservoir comprising:

providing a collapsible container comprising an expandable liquid retaining portion and an inflatable top ring, said collapsible container including a top closure formed by flexible flaps and a zip lock closure;

inflating said top ring;

placing said collapsible container in alignment with the reservoir such that liquid draining from said reservoir drains into said expandable liquid retaining portion;

allowing liquid from said reservoir to drain into said expandable liquid retaining portion, said inflated top ring floating on top of said liquid within said liquid retaining portion;

removing said collapsible container with drained liquid from alignment with the reservoir;

sealing said top closure to retain said drained liquid within said collapsible container;

and draining said liquid from said liquid containing portion into a disposal location.

* * * * *